US007801457B2

(12) United States Patent
Seo et al.

(10) Patent No.: US 7,801,457 B2
(45) Date of Patent: Sep. 21, 2010

(54) FIXING DEVICE, IMAGE FORMING APPARATUS INCLUDING THE FIXING DEVICE, AND FIXING METHOD

(75) Inventors: Hiroshi Seo, Sagamihara (JP); Akiko Ito, Machida (JP); Tadashi Ogawa, Machida (JP); Satoshi Ueno, Kawasaki (JP); Kenji Ishii, Kawasaki (JP)

(73) Assignee: Ricoh Company, Ltd., Tokyo (JP)

( * ) Notice: Subject to any disclaimer, the term of this patent is extended or adjusted under 35 U.S.C. 154(b) by 136 days.

(21) Appl. No.: 12/073,910

(22) Filed: Mar. 12, 2008

(65) Prior Publication Data

US 2008/0226326 A1 Sep. 18, 2008

(30) Foreign Application Priority Data

Mar. 12, 2007 (JP) ..... 2007-061764

(51) Int. Cl.
*G03G 15/20* (2006.01)

(52) U.S. Cl. ..... 399/69; 219/216; 219/619; 399/328; 399/333

(58) Field of Classification Search ..... 399/69, 399/333, 330, 329, 328; 219/216, 619; 347/156; 430/124.3, 124.32

See application file for complete search history.

(56) References Cited

U.S. PATENT DOCUMENTS

2006/0088329 A1* 4/2006 Suzuki et al. ..... 399/69
2007/0242988 A1* 10/2007 Seo et al. ..... 399/328
2008/0025773 A1* 1/2008 Ito et al. ..... 399/333
2008/0063445 A1* 3/2008 Imai et al. ..... 399/333
2008/0152402 A1* 6/2008 Tamemasa et al. ..... 399/329
2008/0181642 A1* 7/2008 Kishi ..... 399/69
2008/0226324 A1* 9/2008 Baba et al. ..... 399/69
2009/0232565 A1* 9/2009 Yasuda et al. ..... 399/328

FOREIGN PATENT DOCUMENTS

JP 2975435 B2 9/1999
JP 2001-013805 1/2001
JP 2005-150103 A * 6/2005
JP 2006-011217 1/2006
JP 2007-279672 A * 10/2007

OTHER PUBLICATIONS

Abstract of JP 04-264479 published on Sep. 21, 1992.

* cited by examiner

*Primary Examiner*—Sophia S Chen
(74) *Attorney, Agent, or Firm*—Harness, Dickey & Pierce, P.L.C.

(57) ABSTRACT

A fixing device includes an excitation coil, a heat-generating layer, a magnetic shunt layer, and a degaussing member. The excitation coil generates a magnetic flux. The heat-generating layer generates heat using the magnetic flux generated by the excitation coil. The magnetic shunt layer transmits heat generated by the heat-generating layer. The degaussing member sandwiches the magnetic shunt layer together with the excitation coil, and selectively performs degaussing by generating a repelling magnetic flux for canceling the magnetic flux generated by the excitation coil so as to activate a self-temperature-control function. The degaussing member selectively refrains from degaussing so as to deactivate the self-temperature-control function.

17 Claims, 16 Drawing Sheets

FIXING DEVICE, IMAGE FORMING APPARATUS INCLUDING THE FIXING DEVICE, AND FIXING METHOD

PRIORITY STATEMENT

The present patent application claims priority from Japanese Patent Application No. 2007-061764, filed on Mar. 12, 2007 in the Japan Patent Office, the entire contents of which are hereby incorporated herein by reference.

BACKGROUND OF THE INVENTION

1. Field of the Invention

Example embodiments generally relate to a fixing device, an image forming apparatus including the fixing device, and a fixing method using, for example, electromagnetic induction heating, implemented by a fixing device incorporated in an image forming apparatus.

2. Description of the Related Art

A related-art image forming apparatus, such as a copier, a printer, a facsimile machine, or a multifunction printer having two or more of copying, printing, scanning, and facsimile functions, forms a toner image on a recording medium (e.g., a recording sheet). For example, an electrostatic latent image formed on an image carrier is made visible with toner into a toner image. The toner image is transferred from the image carrier onto a recording sheet. A fixing device applies heat and pressure to the recording sheet bearing the toner image to fix the toner image on the recording sheet by various methods. Such methods include, for example, a heating roller method, a film method, and an induction heating method.

In a fixing device using the heating roller method, a heat source (e.g., a halogen lamp) heats a heating roller. The heating roller opposes a pressing roller to form a fixing nip between the heating roller and the pressing roller so as to nip a recording sheet bearing a toner image therebetween. At the fixing nip, the heating roller and the pressing roller apply heat and pressure to the recording sheet bearing the toner image.

In a fixing device using the film method, a film having a thermal capacity smaller than a thermal capacity of the heating roller is used as a heating member for applying heat to a recording sheet bearing a toner image.

In one example of a fixing device using the induction heating method, an induction heating coil wound around a bobbin is provided inside a heating roller. When an electric current is applied to the induction heating coil, an eddy current is generated in the heating roller and the heating roller generates heat.

In the heating roller method, the heating roller is preheated so that the heating roller may be heated quickly. By contrast, in the induction heating method, the heating roller may be heated up to a desired temperature quickly, even when the heating roller is not preheated.

Another example of a fixing device using the induction heating method includes both an induction heater and a heating roller. The induction heater includes an induction heating coil to which a power source applies a high-frequency voltage. The heating roller includes a magnetic heat-generating layer that has a Curie point equivalent to a fixing temperature. When the power source applies a high-frequency voltage to the induction heater, the heat-generating layer generates heat.

Thus, for example, a temperature of a ferromagnet included in the heat-generating layer increases quickly until the temperature of the ferromagnet reaches the Curie point. When the temperature of the ferromagnet reaches the Curie point, the heat-generating layer loses its magnetism. Thus, the temperature of the ferromagnet does not exceed the Curie point and is maintained at a desired temperature. The Curie point of the ferromagnet is equivalent to the fixing temperature. Therefore, the temperature of the ferromagnet is maintained at the fixing temperature.

The advantage of such an arrangement is that the heating roller may be quickly and precisely heated to a desired temperature without a complex controller, while a surface of the heating roller provides a proper release property and heat resistance.

In order to self-control an amount of heat generation, such fixing devices using the induction heating method may include a magnetic shunt layer including a magnetic shunt alloy. The magnetic shunt layer is provided between the induction heating coil and a degaussing member. When a temperature of the magnetic shunt alloy increases to the Curie point or higher, a repelling magnetic flux generated by the degaussing member cancels an induction magnetic flux generated by the induction heating coil. For example, when the temperature of the magnetic shunt alloy is near the Curie point, a magnetic permeability of the magnetic shunt alloy sharply decreases. Accordingly, the induction magnetic flux permeates the degaussing member. The degaussing member generates a repelling magnetic flux to activate a self-temperature-control function to prevent the heating roller from being heated up to the Curie point or higher.

Currently, there is market demand for an image forming apparatus capable of providing gloss-mode imaging, in which a glossy toner image is formed. To cope with such demand, a higher Curie point may be applied to the magnetic shunt alloy so that the heating roller may melt and fix toner particles forming a toner image on a recording sheet at a higher fixing temperature. Accordingly, a higher temperature may be applied as an upper temperature limit for limiting temperature increase at both end portions of the heating roller in a direction perpendicular to a conveyance direction of the recording sheet. Consequently, when a large-size recording sheet is conveyed to the heating roller immediately after small-size recording sheets are conveyed to the heating roller, the heating roller may not apply heat of a uniform temperature uniformly to the large-size recording sheet because the small-size recording sheets contact a center portion of the heating roller and draw heat from the center portion. Therefore, a temperature of heat applied by the heating roller to both end portions on the large-size recording sheet in the direction perpendicular to the conveyance direction of the recording sheet differs from a temperature of heat applied by the heating roller to a center portion on the large-size recording sheet. As a result, a fixed toner image on the center portion on the large-size recording sheet may have a gloss level different from a gloss level of a fixed toner image on the both end portions on the large-size recording sheet.

Obviously, such a gloss level difference between the center and the periphery of the sheet is undesirable, and accordingly, there is a need for a technology to minimize or eliminate such gloss level difference.

SUMMARY

At least one embodiment may provide a fixing device that includes an excitation coil, a heat-generating layer, a magnetic shunt layer, and a degaussing member. The excitation coil generates a magnetic flux. The heat-generating layer generates heat using the magnetic flux generated by the excitation coil. The magnetic shunt layer transmits heat generated by the heat-generating layer. The degaussing member sandwiches the magnetic shunt layer together with the excitation coil, and selectively performs degaussing by generating a repelling magnetic flux for canceling the magnetic flux generated by the excitation coil so as to activate a self-temperature-control function. The degaussing member selectively does not perform degaussing so as to deactivate the self-temperature-control function.

At least one embodiment may provide an image forming apparatus that includes a fixing device to apply heat to a recording medium bearing a toner image to fix the toner image on the recording medium. The fixing device includes an excitation coil, a heat-generating layer, a magnetic shunt layer, and a degaussing member. The excitation coil generates a magnetic flux. The heat-generating layer generates heat using the magnetic flux generated by the excitation coil. The magnetic shunt layer transmits heat generated by the heat-generating layer. The degaussing member sandwiches the magnetic shunt layer together with the excitation coil, and selectively performs degaussing by generating a repelling magnetic flux for canceling the magnetic flux generated by the excitation coil so as to activate a self-temperature-control function. The degaussing member selectively does not perform degaussing so as to deactivate the self-temperature-control function.

At least one embodiment may provide a fixing method implemented by a fixing device incorporated in an image forming apparatus. The method includes generating a magnetic flux with an excitation coil, generating heat with a heat-generating layer using the magnetic flux generated with the excitation coil, and transmitting heat generated with the heat-generating layer with a magnetic shunt layer. The method further includes sandwiching the magnetic shunt layer with the excitation coil and a degaussing member, selectively degaussing with the degaussing member by generating a repelling magnetic flux for canceling the magnetic flux generated with the excitation coil so as to activate a self-temperature-control function, and selectively not degaussing so as to deactivate the self-temperature-control function.

Additional features and advantages of example embodiments will be more fully apparent from the following detailed description, the accompanying drawings, and the associated claims.

BRIEF DESCRIPTION OF THE DRAWINGS

A more complete appreciation of example embodiments and the many attendant advantages thereof will be readily obtained as the same becomes better understood by reference to the following detailed description when considered in connection with the accompanying drawings, wherein.

Figure 1:
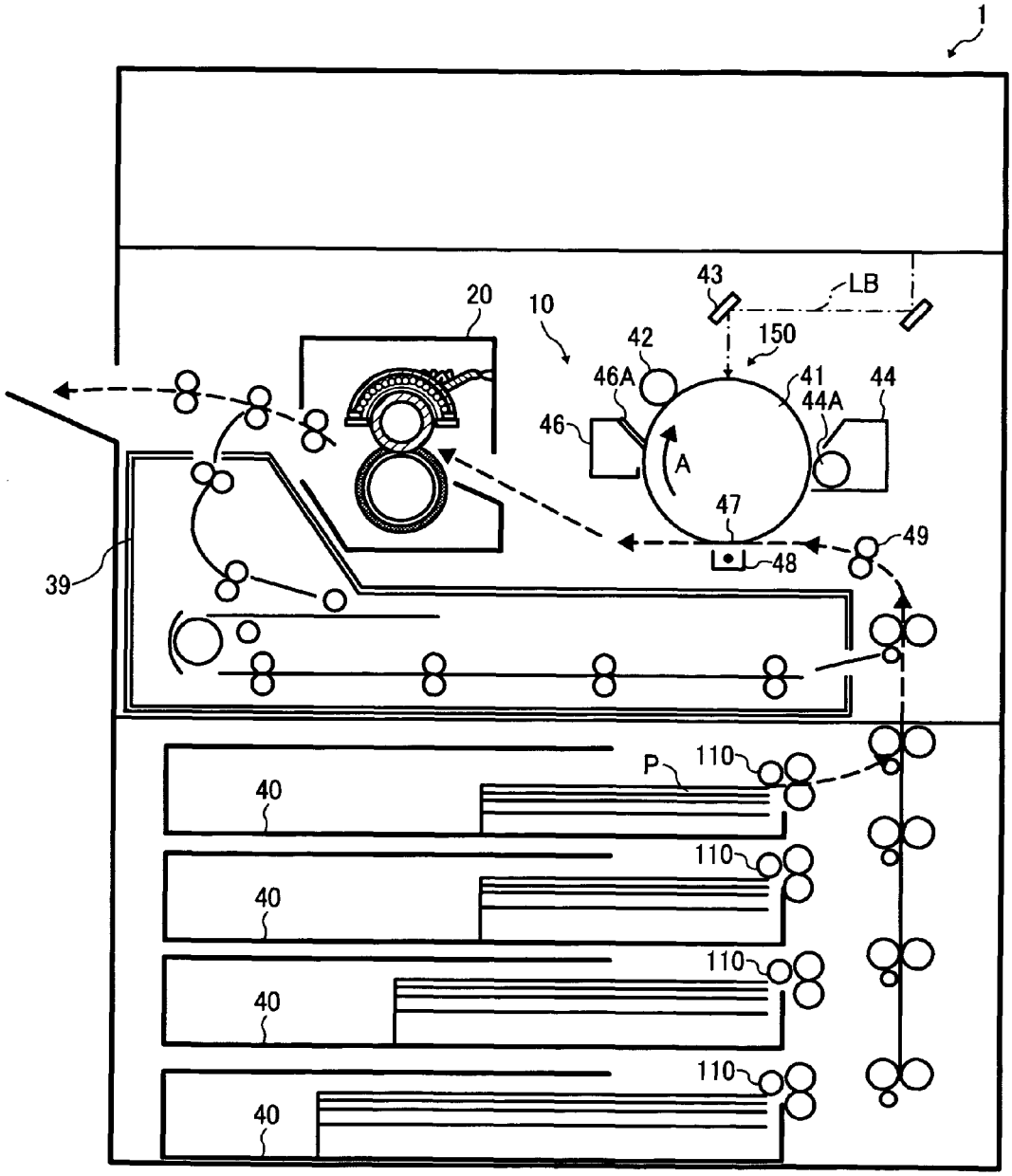
FIG. 1 is a schematic view of an image forming apparatus according to an example embodiment.

The accompanying drawings are intended to depict example embodiments and should not be interpreted to limit the scope thereof. The accompanying drawings are not to be considered as drawn to scale unless explicitly noted.

DETAILED DESCRIPTION OF EXAMPLE EMBODIMENTS

It will be understood that if an element or layer is referred to as being "on", "against", "connected to", or "coupled to" another element or layer, then it can be directly on, against, connected or coupled to the other element or layer, or intervening elements or layers may be present. In contrast, if an element is referred to as being "directly on", "directly connected to", or "directly coupled to" another element or layer, then there are no intervening elements or layers present. Like numbers refer to like elements throughout. As used herein, the term "and/or" includes any and all combinations of one or more of the associated listed items.

Spatially relative terms, such as "beneath", "below", "lower", "above", "upper", and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, term such as "below" can encompass both an orientation of above and below. The device may be otherwise oriented (rotated 90 degrees or at other orientations) and the spatially relative descriptors used herein are interpreted accordingly.

Although the terms first, second, etc. may be used herein to describe various elements, components, regions, layers and/or sections, it should be understood that these elements, components, regions, layers and/or sections should not be limited by these terms. These terms are used only to distinguish one element, component, region, layer, or section from another region, layer, or section. Thus, a first element, component, region, layer, or section discussed below could be termed a second element, component, region, layer, or section without departing from the teachings of the present invention.

The terminology used herein is for the purpose of describing particular embodiments only and is not intended to be limiting of the present invention. As used herein, the singular forms "a", "an", and "the" are intended to include the plural forms as well, unless the context clearly indicates otherwise. It will be further understood that the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

In describing example embodiments illustrated in the drawings, specific terminology is employed for the sake of clarity. However, the disclosure of this specification is not intended to be limited to the specific terminology so selected and it is to be understood that each specific element includes all technical equivalents that operate in a similar manner.

Referring now to the drawings, wherein like reference numerals designate identical or corresponding parts throughout the several views, particularly to FIG. 1, an image forming apparatus 1 according to an example embodiment is explained.

As illustrated in FIG. 1, the image forming apparatus 1 includes a mirror 43, an image forming device 10, paper trays 40, feed rollers 110, a registration roller pair 49, a transfer device 48, a cleaner 46, a fixing device 20, and/or a duplex device 39. The image forming device 10 includes a photoconductor 41, a charger 42, and/or a development device 44. The development device 44 includes a development roller 44A. The cleaner 46 includes a blade 46A.

The image forming apparatus 1 may be a copier, a facsimile machine, a printer, a multifunction printer having at least one of copying, printing, scanning, and facsimile functions, or the like. According to this non-limiting example embodiment, the image forming apparatus 1 functions as a monochrome printer for forming a monochrome image on a recording medium (e.g., a recording sheet). However, the image forming apparatus 1 is not limited to the monochrome printer and may form a color and/or monochrome image with other structure.

The photoconductor 41 is provided in an upper portion of the image forming apparatus 1 and serves as an image carrier. The photoconductor 41 may be an electrophotographic photoconductor having a drum shape and rotates in a direction of rotation A. The charger 42, the mirror 43, the development device 44, the transfer device 48, and the cleaner 46 are disposed around the photoconductor 41 in this order in the direction of rotation A. The charger 42 has a roller shape. The mirror 43 forms a part of an exposure device (not shown). The paper trays 40 and the feed rollers 110 are provided in a lower portion of the image forming apparatus 1. The paper trays 40 load a recording medium (e.g., recording sheets P).

Referring to FIG. 1, the following describes an image forming operation performed by the image forming apparatus 1. When the photoconductor 41 starts rotating, the charger 42 uniformly charges a surface of the photoconductor 41 in the dark. The exposure device emits a light beam LB toward the charged surface of the photoconductor 41 according to image data. For example, in the exposure device, a light source (not shown) emits a light beam LB toward the mirror 43. The mirror 43 reflects the light beam LB toward an exposure position 150 between charger 42 and the development roller 44A on the surface of the photoconductor 41 and the light beam LB scans on the surface of the photoconductor 41. Accordingly, an electrostatic latent image is formed on the surface of the photoconductor 41.

When the electrostatic latent image reaches a position near or contacting the development device 44 by the rotation of the photoconductor 41, the development device 44 visualizes the electrostatic latent image with toner to form a toner image. The rotation of the photoconductor 41 moves the toner image to a transfer position 47 at which the transfer device 48 opposes a lower surface of the photoconductor 41.

One of the feed rollers 110 feeds a recording sheet P from a corresponding paper tray 40 toward the registration roller pair 49. For example, the recording sheet P is guided by a conveyance guide (not shown) and fed by conveyance rollers (not shown) toward the registration roller pair 49 via a conveyance path illustrated in a broken line. The registration roller pair 49 is provided upstream from the transfer position 47 in a conveyance direction of the recording sheet P. The registration roller pair 49 temporarily stops the recording sheet P and feeds the recording sheet P toward the transfer position 47 at a time when the toner image formed on the photoconductor 41 opposes a proper position on the recording sheet P at the transfer position 47. Namely, the registration roller pair 49 feeds the recording sheet P stopped at the registration roller pair 49 toward the transfer position 47 at a proper time.

When the toner image formed on the photoconductor 41 opposes the proper position on the recording sheet P, to which the toner image is transferred, at the transfer position 47, an electric field generated by the transfer device 48 attracts and transfers the toner image onto the recording sheet P.

The rotation of the photoconductor 41 conveys residual toner particles not transferred onto the recording sheet P at the transfer position 47 and thereby remaining on the surface of the photoconductor 41 to the cleaner 46. While the residual toner particles pass the cleaner 46, the blade 46A slides on the surface of the photoconductor 41 to remove the residual toner particles from the surface of the photoconductor 41. Thus, the photoconductor 41 becomes ready for a subsequent toner image forming operation.

The recording sheet P bearing the toner image is fed toward the fixing device 20. The fixing device 20 is provided downstream from the transfer position 47 in the conveyance direction of the recording sheet P. When the recording sheet P passes through the fixing device 20, the fixing device 20 applies heat and pressure to the recording sheet P to fix the toner image on the recording sheet P. The recording sheet P bearing the fixed toner image is output onto an output portion (not shown).

When a toner image is to be formed on another side (e.g., a back side) of the recording sheet P, a branch nail (not shown) guides the recording sheet P toward the duplex device 39. The duplex device 39 is provided downstream from the fixing device 20 in the conveyance direction of the recording sheet P. The duplex device 39 reverses the recording sheet P to cause a front side of the recording sheet P, on which the toner image is formed, to face down, and feeds the reversed recording sheet P toward the transfer position 47. For example, the duplex device 39 switches back and reverses the recording sheet P and feeds the reversed recording sheet P to the conveyance path provided upstream from the registration roller pair 49 in the conveyance direction of the recording sheet P.

Figure 2:
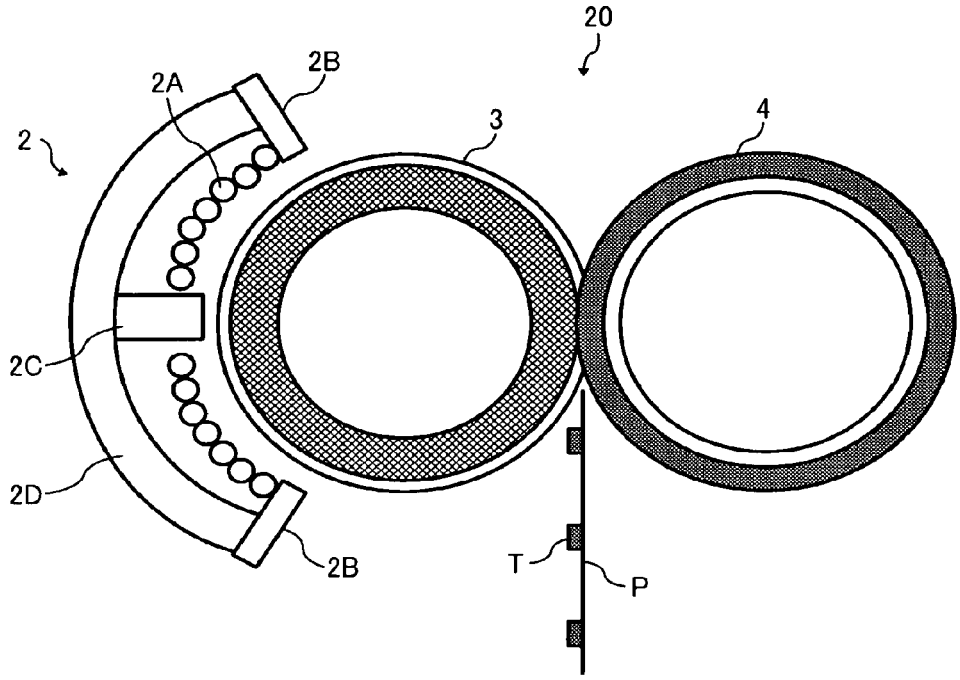
FIG. 2 is a sectional view (according to an example embodiment) of a fixing device included in the image forming apparatus shown in FIG. 1.

Referring to FIG. 2, the following describes the fixing device 20. FIG. 2 is a sectional view of the fixing device 20. The fixing device 20 includes a magnetic flux generator 2, a fixing roller 3, and/or a pressing roller 4. The magnetic flux generator 2 includes a coil 2A, side cores 2B, a center core 2C, and/or an arc core 2D.

The fixing device 20 uses a roller method in which a pair of rollers (e.g., the fixing roller 3 and the pressing roller 4) applies heat and pressure to a recording sheet P to fix a toner image T on the recording sheet P. The pressing roller 4, serving as a rotating pressing member, pressingly contacts the fixing roller 3, serving as a rotating heat generation member, to form a nip between the pressing roller 4 and the fixing roller 3.

An inverter (not shown), serving as an induction heating circuit, drives the coil 2A (e.g., an excitation coil or an induction coil) with a high-frequency current to generate a high-frequency magnetic field. The magnetic field generates an eddy current in the fixing roller 3 including metal and the eddy current generates heat. Thus, a temperature of the fixing roller 3 increases. The coil 2A is provided between the fixing roller 3 and the arc core 2D.

Figure 3:
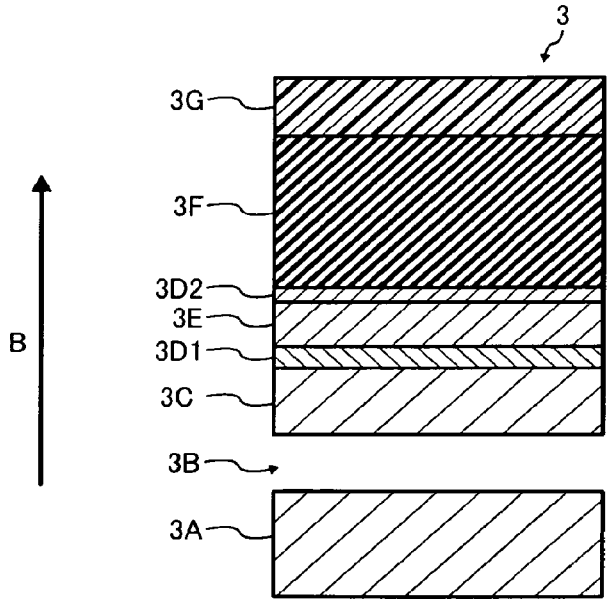
FIG. 3 is a partially enlarged sectional view (according to an example embodiment) of a fixing roller included in the fixing device shown in FIG. 2.

FIG. 3 is a partially enlarged sectional view of the fixing roller 3. The fixing roller 3 includes a degaussing layer 3A, an insulating layer 3B, a magnetic shunt layer 3C, an antioxidant layer 3D1, a heat-generating layer 3E, an antioxidant layer 3D2, an elastic layer 3F, and/or a releasing layer 3G.

The fixing roller 3 has a diameter of about 40 mm, for example. The degaussing layer 3A (e.g., a core metal) is provided at an innermost portion of the fixing roller 3. The insulating layer 3B, the magnetic shunt layer 3C, the antioxidant layer 3D1, the heat-generating layer 3E, the antioxidant layer 3D2, the elastic layer 3F, and the releasing layer 3G are layered on the degaussing layer 3A in this order in a direction B. Thus, the releasing layer 3G is provided at an outermost portion of the fixing roller 3 and forms a surface layer contacting a toner image T on a recording sheet P.

The degaussing layer 3A includes aluminum or an alloy of aluminum. The insulating layer 3B includes air and forms a space having a thickness of about 5 mm. The magnetic shunt layer 3C includes a known magnetic shunt alloy properly selected and has a thickness of about 50 μm. Each of the antioxidant layers 3D1 and 3D2 includes nickel strike plating and has a thickness of about 1 μm or smaller. The heat-generating layer 3E includes copper plating and has a thickness of about 15 μm. The elastic layer 3F includes a silicone rubber and has a thickness of about 150 μm. The releasing layer 3G includes PFA (perfluoroalkoxy) and has a thickness of about 30 μm. Namely, the magnetic shunt layer 3C, the antioxidant layer 3D1, the heat-generating layer 3E, the antioxidant layer 3D2, the elastic layer 3F, and the releasing layer 3G have a thickness of from about 200 μm to about 250 μm in total, for example.

The magnetic shunt layer 3C includes a magnetic body (e.g., a magnetic shunt alloy material including iron and/or nickel) having a Curie point of from about 100 degrees centigrade to about 300 degrees centigrade, for example. Pressure applied by the pressing roller 4 (depicted in FIG. 2) deforms the magnetic shunt layer 3C to form a nip between the pressing roller 4 and the fixing roller 3. The magnetic shunt layer 3C prevents the heat-generating layer 3E and/or the like from being overheated. The fixing roller 3 is deformed to have a concave shape to form the nip. Therefore, a recording sheet P may easily separate from the nip. According to this example embodiment, layers other than the degaussing layer 3A, that is, the magnetic shunt layer 3C, the antioxidant layer 3D1, the heat-generating layer 3E, the antioxidant layer 3D2, the elastic layer 3F, and the releasing layer 3G, are deformed by the pressure applied by the pressing roller 4.

Figure 4A:
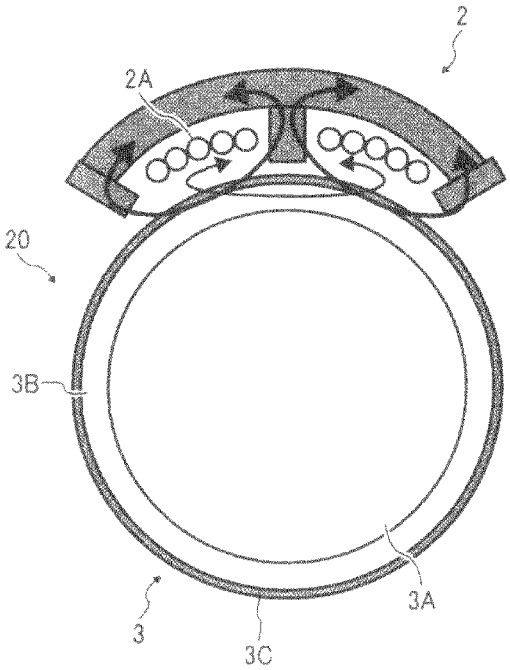
FIG. 4A is a sectional view (according to an example embodiment) of a magnetic flux generator and a fixing roller included in the fixing device shown in FIG. 2 when a magnetic flux generated by the magnetic flux generator does not permeate the fixing roller.

FIG. 4A is a sectional view of the fixing roller 3. In FIG. 4A, thick solid arrows illustrate induction magnetic fluxes generated by the coils 2A and thin solid arrows illustrate eddy currents. When a temperature Te of a magnetic shunt alloy included in the magnetic shunt layer 3C is lower than a Curie point Tc, the magnetic shunt alloy included in the magnetic shunt layer 3C has magnetism. Accordingly, the induction magnetic fluxes generated by the coils 2A do not permeate the magnetic shunt layer 3C or the insulating layer 3B. Namely, when the temperature Te of the magnetic shunt layer 3C is lower than the Curie point Tc, the induction magnetic fluxes do not permeate the magnetic shunt layer 3C and thereby do not reach the degaussing layer 3A, as illustrated in FIG. 4A. Thus, heat generation is not suppressed in the fixing device 20.

Figure 4B:
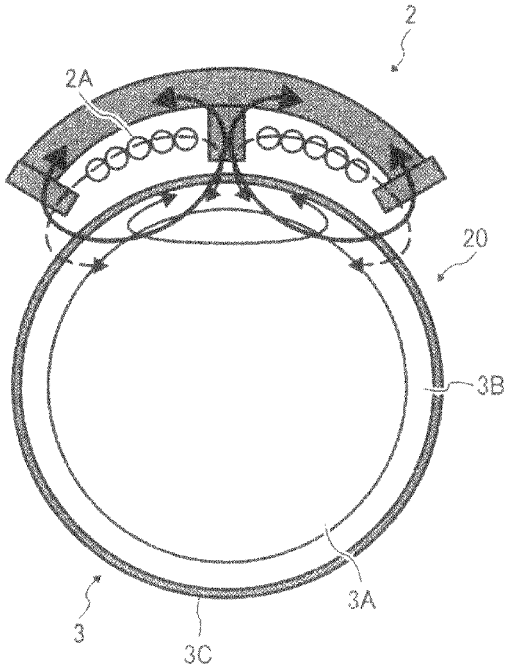
FIG. 4B is a sectional view (according to an example embodiment) of the magnetic flux generator and the fixing roller shown in FIG. 4A when the magnetic flux generated by the magnetic flux generator permeates the fixing roller.

FIG. 4B is a sectional view of the fixing roller 3. FIG. 4B illustrates induction magnetic fluxes permeating the magnetic shunt layer 3C and the insulating layer 3B and reaching the degaussing layer 3A. Broken arrows illustrate induction magnetic fluxes generated by the degaussing layer 3A including aluminum or an alloy of aluminum. When the temperature Te of the magnetic shunt alloy included in the magnetic shunt layer 3C is higher than the Curie point Tc, the magnetic shunt alloy included in the magnetic shunt layer 3C loses its magnetism and becomes a non-magnetic body. Accordingly, the induction magnetic fluxes reach the degaussing layer 3A even if the insulating layer 3B is provided. Thus, heat generation is suppressed in the fixing device 20.

As illustrated in FIG. 3, the magnetic shunt layer 3C, which includes a magnetic body and/or the function of the heat-generating layer 3E, is heated instantly until the temperature Te of the magnetic shunt layer 3C reaches the Curie point. When the temperature Te of the magnetic shunt layer 3C reaches the Curie point, the magnetic shunt layer 3C loses its magnetism and thereby is not heated further, maintaining a constant temperature. Therefore, when the magnetic shunt layer 3C includes a magnetic body having a Curie point of from about 100 degrees centigrade to about 300 degrees centigrade, that is, a temperature used in roller type fixing devices like the fixing device 20, the heat-generating layer 3E and the degaussing layer 3A may not be overheated and thereby may maintain a proper fixing temperature. Accordingly, a surface of the fixing roller 3 may provide a proper release property and heat resistance property without a complex control.

Figure 5:
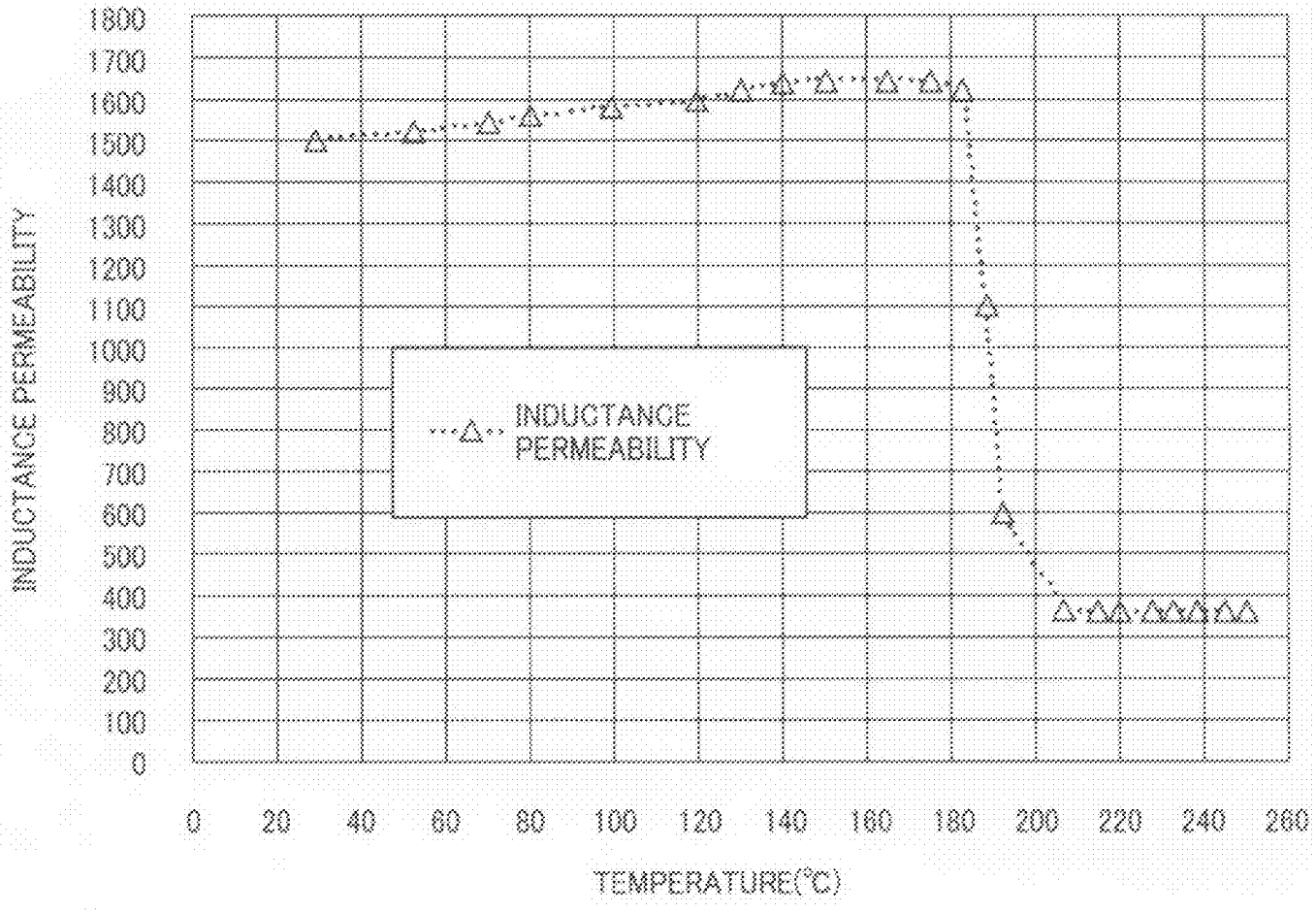
FIG. 5 is a graph (according to an example embodiment) illustrating a relation between a temperature and an inductance permeability.

FIG. 5 illustrates a magnetic permeability (e.g., an inductance permeability) varying depending on a temperature. In FIG. 5, Δ indicates a magnetic permeability at each temperature. The magnetic permeability sharply decreases at a reference temperature.

When the magnetic shunt layer 3C (depicted in FIG. 3) includes a single layer, the magnetic shunt layer 3C may deform when the magnetic shunt layer 3C includes an alloy including iron and/or nickel and has a thickness of about 150 μm or smaller. Alternatively, the magnetic shunt layer 3C may include a deformable base layer (not shown) and a magnetic layer (not shown) plated on the base layer, for example. Thus, the magnetic shunt layer 3C may be properly deformed with reduced rupture of the magnetic shunt layer 3C.

The insulating layer 3B (depicted in FIG. 3), on which the magnetic shunt layer 3C is formed, may preferably include a material having a thermal conductivity lower than a thermal conductivity of the magnetic shunt layer 3C. Accordingly, the heat-generating layer 3E (depicted in FIG. 3) may provide an increased thermal efficiency. The insulating layer 3B may include a material having a thermal conductivity (e.g., about 0.1 W/mK) lower than the thermal conductivity of the magnetic shunt layer 3C, such as a foamed silicone rubber. For example, when the magnetic shunt layer 3C has a thermal conductivity of about 11 W/mK, the insulating layer 3B may be an air layer as illustrated in FIG. 3 or other layer. The insulating layer 3B may or may not include an elastic body. When the insulating layer 3B includes the elastic body, pressure (e.g., a nip pressure) applied by the pressing roller 4 (depicted in FIG. 2) may be increased to provide an improved fixing property.

The insulating layer 3B may preferably have a thickness of about 10 mm or smaller or any other appropriate thickness calculated based on a strength of a magnetic flux and/or the like, so as to cause a magnetic flux permeating the magnetic shunt layer 3C to reach a conductive material.

According to this example embodiment, the rotating heat generation member (e.g., the fixing roller 3) has a roller shape. However, the rotating heat generation member may have a sleeve or a belt shape. When the magnetic shunt layer 3C is provided separately from the heat-generating layer 3E, the magnetic shunt layer 3C may be fixed or may not be fixed to the heat-generating layer 3E. When the magnetic shunt layer 3C is not fixed to the heat-generating layer 3E, a belt or a sleeve may include the heat-generating layer 3E and a roller may include the magnetic shunt layer 3C.

Figure 6A:
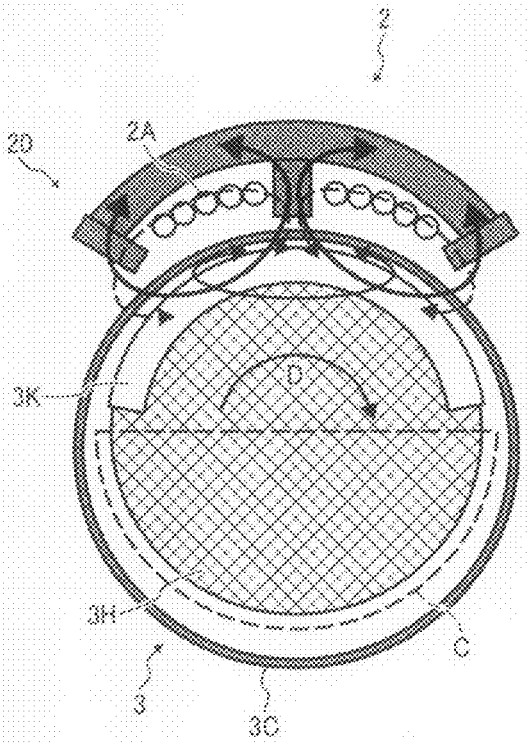
FIG. 6A is a sectional view (according to an example embodiment) of a degaussing member provided inside the fixing roller shown in FIG. 2 when a degaussing function is activated.
Figure 6B:
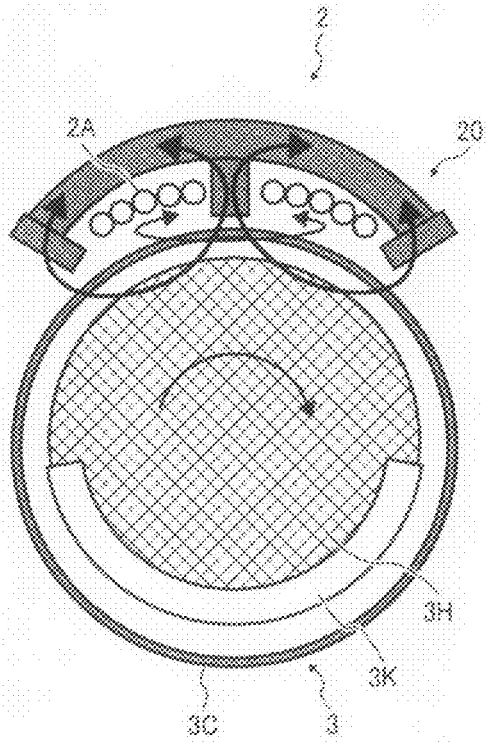
FIG. 6B is a sectional view (according to an example embodiment) of the degaussing member shown in FIG. 6A when the degaussing function is not activated.

As illustrated in FIGS. 6A and 6B, the fixing device 20 further includes a magnetic core 3H and/or a degaussing member 3K. The magnetic core 3H and the degaussing member 3K are provided inside the magnetic shunt layer 3C having an increased Curie point. The degaussing member 3K has a plate shape forming a semi-cylindrical shape in cross section, and includes a material having a volume resistivity lower than a volume resistivity of a magnetic shunt alloy included in the magnetic shunt layer 3C. The degaussing member 3K is rotatable with the magnetic core 3H inside the magnetic shunt layer 3C. For example, the magnetic core 3H rotates in a circular space formed by the magnetic shunt layer 3C. A driver (not shown) supports and drives the magnetic core 3H. Rotation of the magnetic core 3H moves the degaussing member 3K closer to and away from the magnetic flux generator 2. Namely, rotation of the magnetic core 3H selectively turns on and off a degaussing function of the degaussing member 3K. The degaussing member 3K may include a conductive material, such as aluminum or an alloy of aluminum. However, the degaussing member 3K may include other material and may have a shape other than the shape illustrated in FIGS. 6A and 6B. The driver for driving the magnetic core 3H may include various mechanisms for moving an element in a cylinder having a structure similar to the structure illustrated in FIGS. 6A and 6B.

The magnetic core 3H includes a semicircular portion C illustrated in broken line in FIG. 6A. The semicircular portion C is provided opposite the degaussing member 3K in a direction of rotation D of the degaussing member 3K. The semicircular portion C includes a high-resistance magnetic body.

In FIGS. 6A and 6B, thick solid arrows indicate induction magnetic fluxes generated by the coils 2A, thin solid arrows indicate eddy currents, and broken arrows indicate induction magnetic fluxes generated by the degaussing member 3K including aluminum or an alloy of aluminum.

FIG. 6A is a sectional view of the fixing roller 3 when the degaussing function of the degaussing member 3K is turned on. The degaussing member 3K is positioned close to the coil 2A. When the temperature Te of the magnetic shunt alloy included in the magnetic shunt layer 3C is not lower than the Curie point Tc, the magnetic shunt alloy included in the magnetic shunt layer 3C loses its magnetism and becomes a non-magnetic body, providing an increased degaussing function.

FIG. 6B is a sectional view of the fixing roller 3 when the degaussing function of the degaussing member 3K is not turned on. The degaussing member 3K is positioned away from and opposite to the coil 2A. Therefore, although induction magnetic fluxes generated by the coil 2A permeates the magnetic shunt layer 3C, the temperature Te of the magnetic shunt alloy included in the magnetic shunt layer 3C is higher than the Curie point Tc and thereby the degaussing member 3K does not generate an induction magnetic flux. Accordingly, the degaussing member 3K may not provide its degaussing function. A magnetic shunt alloy included in the magnetic shunt layer 3C does not lose its magnetism and maintains to be a magnetic body.

Figure 7:
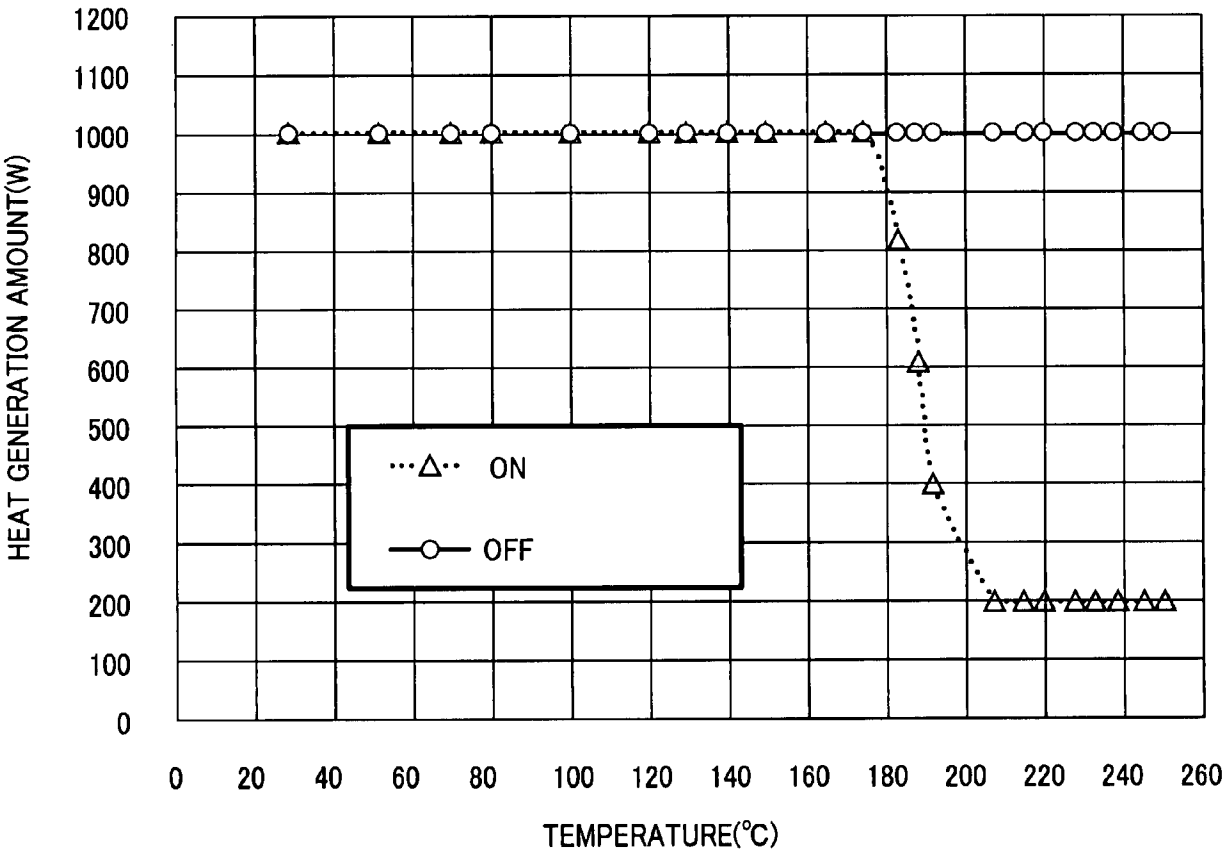
FIG. 7 is a graph (according to an example embodiment) illustrating a relation between a temperature and a heat generation amount.

The fixing device 20 according to this example embodiment may provide a control for suppressing heat generation by moving the degaussing member 3K together with the magnetic core 3H. FIG. 7 illustrates a heat generation amount varying depending on a temperature. In FIG. 7, Δ indicates the heat generating amount when a degaussing member, such as the degaussing member 3K depicted in FIGS. 6A and 6B, is turned on and ○ indicates the heat generation amount when the degaussing member is turned off. Heat generated by the magnetic shunt layer 3C (depicted in FIGS. 6A and 6B) may be controlled based on data illustrated in FIG. 7 by changing a position of the degaussing member 3K with respect to the coil 2A (depicted in FIGS. 6A and 6B).

Figure 8:
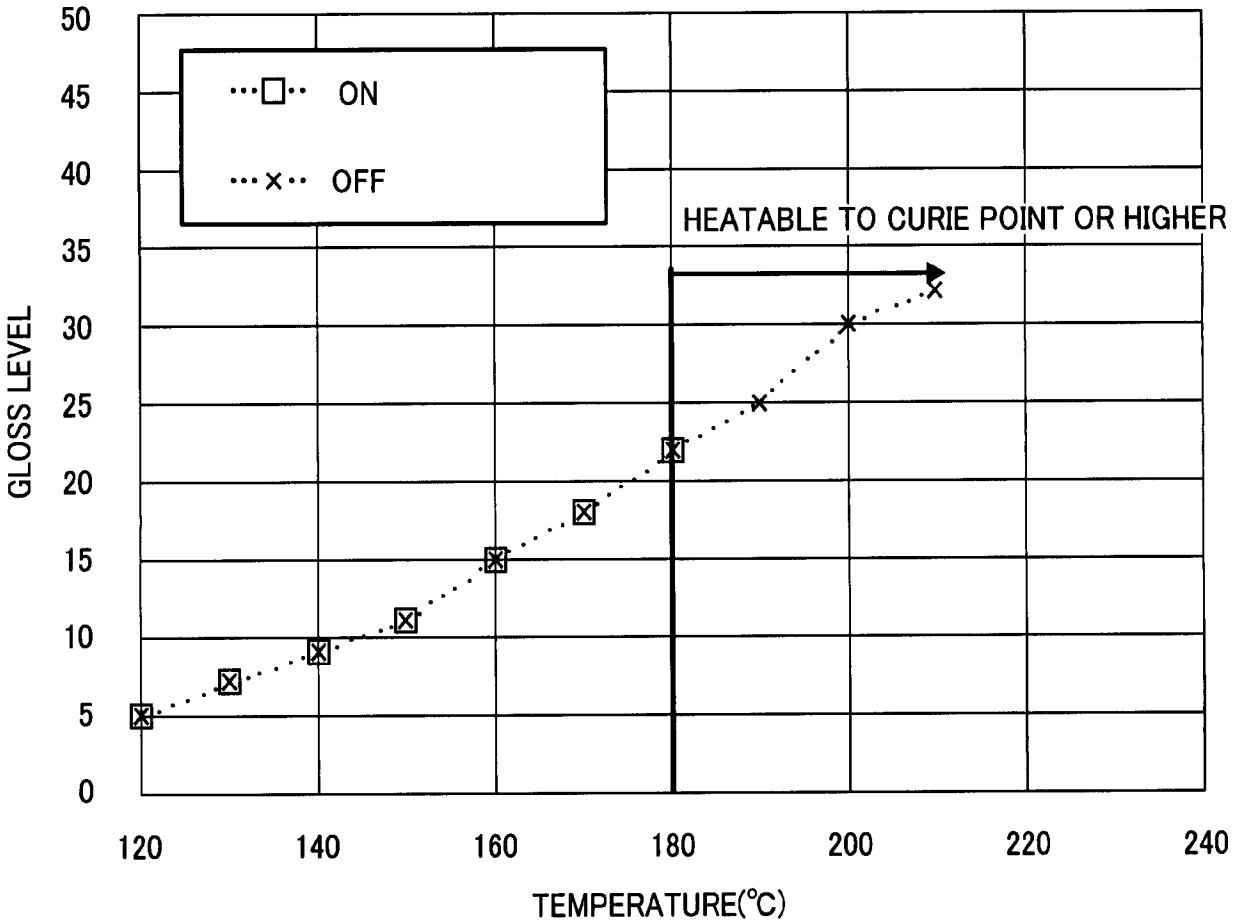
FIG. 8 is a graph (according to an example embodiment) illustrating a relation between a temperature and a gloss level.

FIG. 8 illustrates a gloss level varying depending on a temperature. In FIG. 8, □ indicates the gloss level when a degaussing member, such as the degaussing member 3K depicted in FIGS. 6A and 6B, is turned on and x indicates the gloss level when the degaussing member is turned off. When the degaussing function is turned on and the magnetic shunt layer 3C (depicted in FIG. 6A) may be heated up to a temperature not lower than the Curie point, the temperature is saturated at 180 degrees centigrade. When the degaussing function is turned off, the magnetic shunt layer 3C (depicted in FIG. 6B) may be heated up to a temperature not lower than 200 degrees centigrade, providing a desired increased gloss level.

Figure 9:
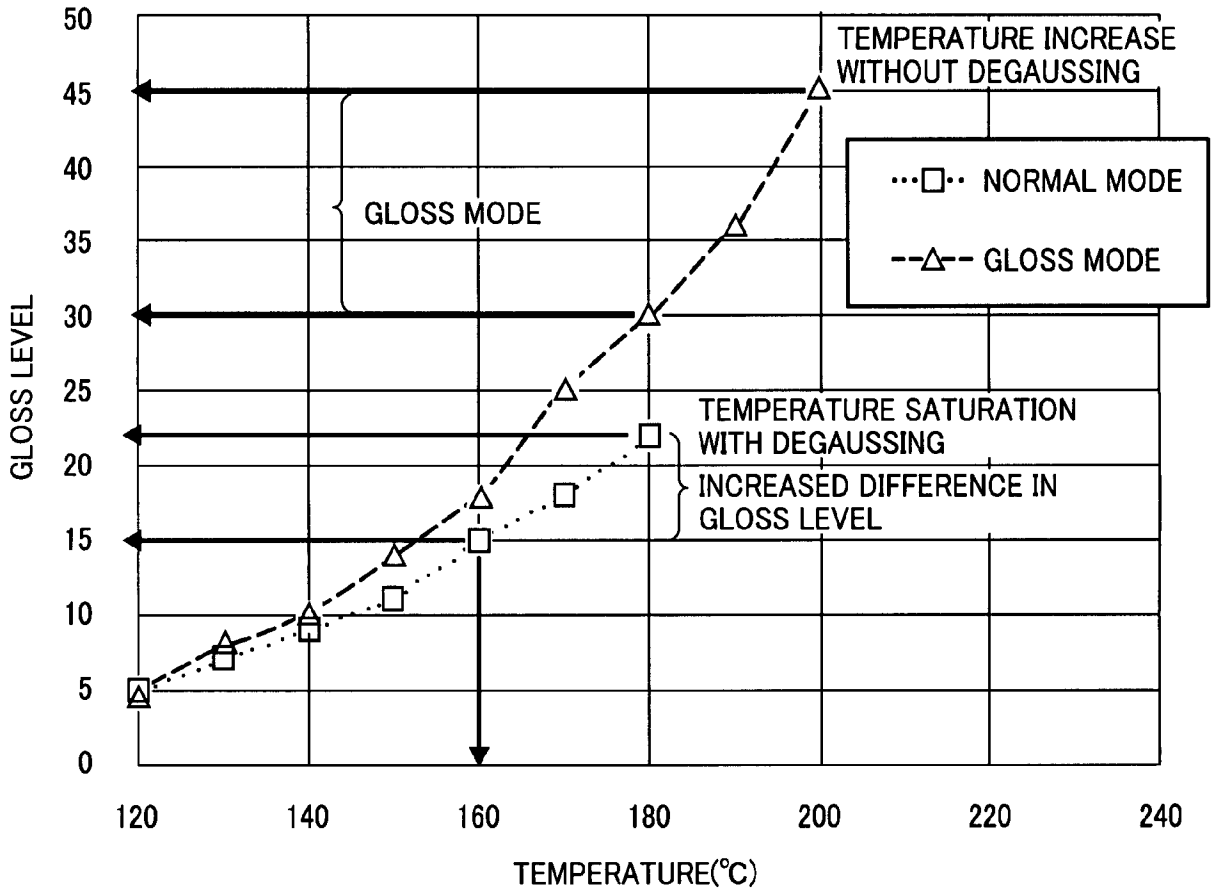
FIG. 9 is a graph (according to an example embodiment) illustrating a relation between a temperature and a gloss level in a normal mode and a gloss mode.

FIG. 9 illustrates a gloss level varying depending on a temperature when the degaussing function suppresses heat generation. In FIG. 9, □ indicates the gloss level in a normal mode and Δ indicates the gloss level in a gloss mode for forming a toner image having a high gloss level. In the gloss mode providing a gloss level of from 30 to 45, the temperature of the magnetic shunt layer 3C (depicted in FIG. 3), actually a temperature of the surface layer of the fixing roller 3 (depicted in FIG. 3), may be increased without temperature saturation when the degaussing function is not used. In the normal mode providing a gloss level of from 15 to 22 or 23, temperature increase of the magnetic shunt layer 3C is saturated by using the degaussing function. A small-size recording sheet is conveyed on a center portion of the fixing roller 3 but is not conveyed on both end portions of the fixing roller 3 in a direction perpendicular to a conveyance direction of the recording sheet. A large-size recording sheet is conveyed on the center portion and the both end portions of the fixing roller 3. Therefore, when a toner image on the large-size recording sheet is fixed after a toner image on the small-size recording sheet is fixed, the fixed toner image on the large-size recording sheet provides an increased difference in gloss level between the center portion and the both end portions. FIG. 9 illustrates a comparison between the gloss mode and the normal mode at a low linear speed at which recording sheets are conveyed. When the temperature is 160 degrees centigrade, the difference in gloss level generated due to increase in temperature of both end portions of the fixing roller 3 after small-size recording sheets are continuously conveyed may be suppressed within about 10 percent. The gloss mode may provide a gloss level of up to about 45 percent.

Figure 10A:
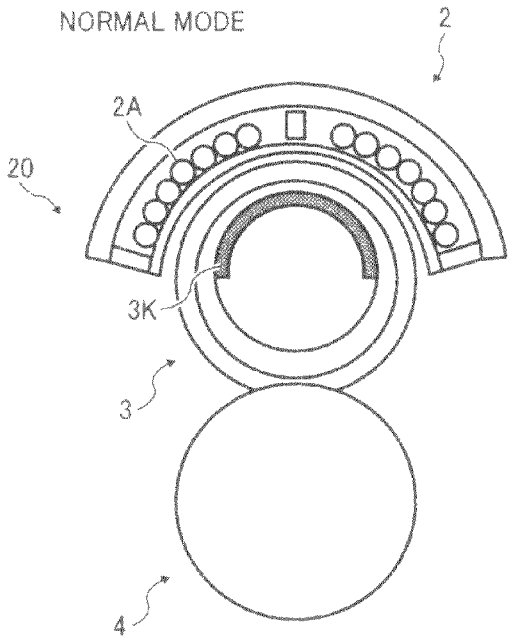
FIG. 10A is a sectional view (according to an example embodiment) of the degaussing member shown in FIG. 6A in the normal mode.
Figure 10B:
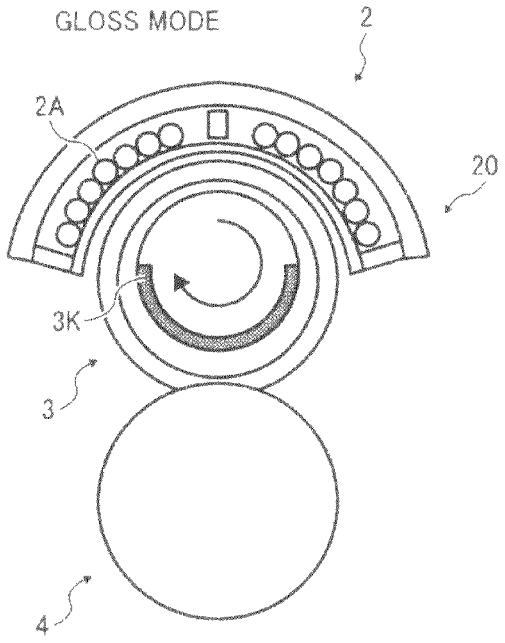
FIG. 10B is a sectional view (according to an example embodiment) of the degaussing member shown in FIG. 6B in the gloss mode.

Accordingly, in the normal mode, the degaussing member 3K may be positioned as illustrated in FIG. 10A and may operate as illustrated in FIG. 6A. In the gloss mode, the degaussing member 3K may be positioned as illustrated in FIG. 10B and may operate as illustrated in FIG. 6B.

Figure 11A:
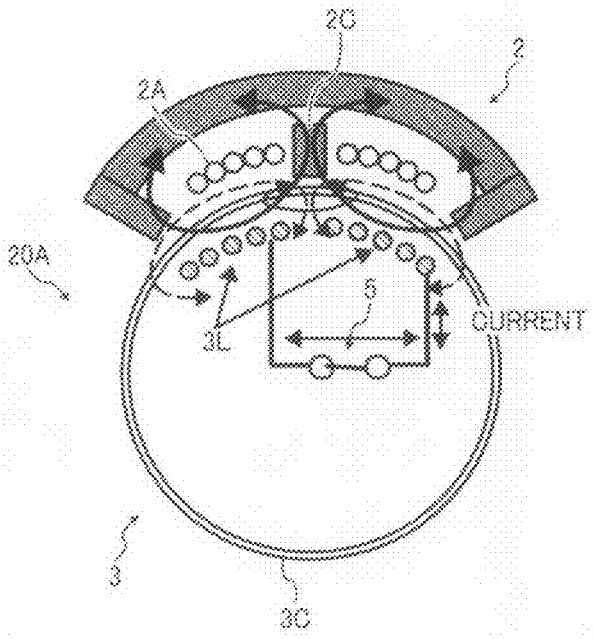
FIG. 11A is a sectional view of a fixing device according to another example embodiment when a degaussing function is activated.
Figure 11B:
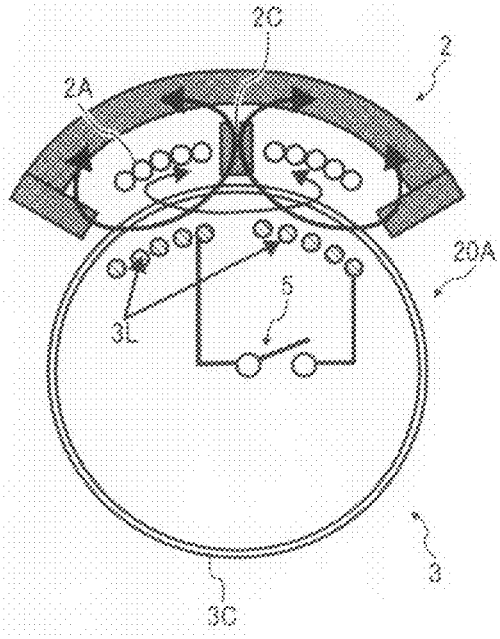
FIG. 11B is a sectional view (according to an example embodiment) of the fixing device shown in FIG. 11A when the degaussing function is not activated.

Referring to FIGS. 11A and 11B, the following describes a fixing device 20A according to another example embodiment. The fixing device 20A includes a pair of degaussing coils 3L and/or a switch element 5. The other elements of the fixing device 20A are common to the fixing device 20 depicted in FIGS. 4A and 4B.

The pair of degaussing coils 3L and the switch element 5 form a degaussing member. The pair of degaussing coils 3L, serving as supplemental coils, is provided inside the magnetic shunt layer 3C. The switch element 5 causes a short circuit (e.g., conduction) between the degaussing coils 3L or opens to break conduction between the degaussing coils 3L so as to suppress magnetic fluxes. The fixing device 20A does not include a mechanism for moving the pair of degaussing coils 3L, saving space.

In FIGS. 11A and 11B, thick solid arrows indicate induction magnetic fluxes generated by the coils 2A. Thin solid arrows indicate eddy currents. Broken arrows indicate degaussing magnetic fluxes generated by the pair of degaussing coils 3L and canceling the induction magnetic fluxes generated by the coils 2A.

FIG. 11A is a sectional view of the fixing roller 3 in which a degaussing function is activated. For example, the switch element 5 is turned on to cause a short circuit between the degaussing coils 3L and to generate degaussing magnetic fluxes. Thus, the fixing device 20A activates the degaussing function. Accordingly, magnetic fluxes affecting the heat-generating layer 3E (depicted in FIG. 3) are reduced and heat generation is suppressed.

FIG. 11B is a sectional view of the fixing roller 3 in which the degaussing function is not activated. For example, the switch element 5 is turned off to break conduction between the degaussing coils 3L and not to generate degaussing magnetic fluxes. Thus, the fixing device 20A does not activate the degaussing function. Accordingly, magnetic fluxes affecting the heat-generating layer 3E (depicted in FIG. 3) are not reduced and heat generation is not suppressed.

The pair of degaussing coils 3L is provided away from the coils 2A and opposes the coils 2A via the magnetic shunt layer 3C. Therefore, the induction magnetic fluxes generated by the coils 2A permeate the magnetic shunt layer 3C. However, the pair of degaussing coils 3L does not generate induction magnetic fluxes, because the temperature Te of the magnetic shunt alloy included in the magnetic shunt layer 3C is higher than the Curie point Tc. Accordingly, the magnetic shunt alloy does not lose its magnetism and maintains to be a magnetic body.

Figure 12:
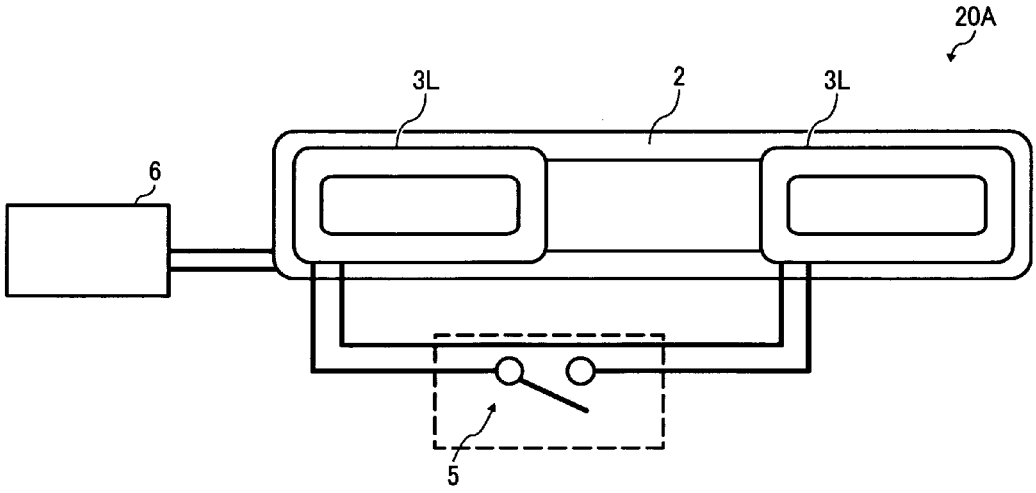
FIG. 12 is a conceptual diagram (according to an example embodiment) of the fixing device shown in FIGS. 11A and 11B.

As illustrated in FIG. 12, the fixing device 20A further includes an inverter 6. The inverter 6 serves as a driver or a power source, and forms a degaussing member together with the pair of degaussing coils 3L and the switch element 5. FIG. 12 is a conceptual diagram illustrating a relation among the magnetic flux generator 2 including the coil 2A (depicted in FIGS. 11A and 11B) serving as a main coil, the pair of degaussing coils 3L, the switch element 5, and the inverter 6. The switch element 5 may include but is not limited to a switch or a variable resistive element. The pair of degaussing coils 3L serves as sub coils or supplemental coils and is not directly connected to the driver.

The inverter 6 drives the pair of degaussing coils 3L by applying a high-frequency current having a phase different from a phase applied to the coil 2A (depicted in FIG. 11A) to cause the pair of degaussing coils 3L to generate a magnetic flux canceling the magnetic flux generated by the coil 2A.

As illustrated in FIGS. 11A and 11B, the center core 2C divides the pair of degaussing coils 3L. According to this example embodiment, one of the pair of degaussing coils 3L provided in the left of the center core 2C includes a plurality of coils. Another one of the pair of degaussing coils 3L provided in the right of the center core 2C also includes a plurality of coils. For example, about three coils may be preferably provided in the left and the right of the center core 2C each. However, one or more coils may be provided and the number of coils is not limited.

The switch element 5 may perform control by changing a switch ratio per unit time. Various known controls may be applied to the switch element 5.

Figure 13A:
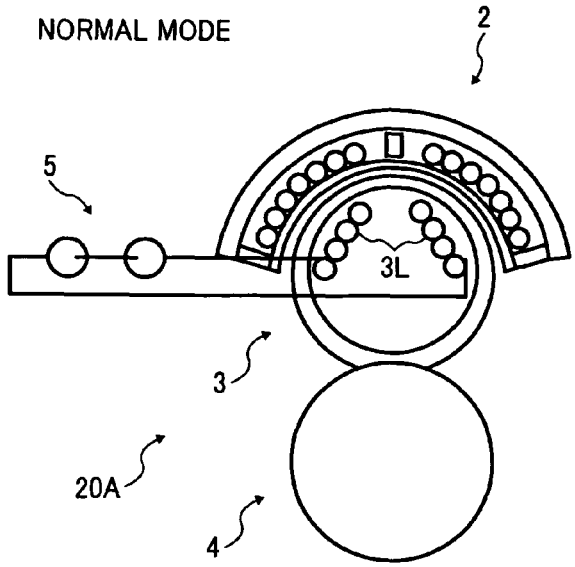
FIG. 13A is a sectional view (according to an example embodiment) of the fixing device shown in FIG. 11A in the normal mode.
Figure 13B:
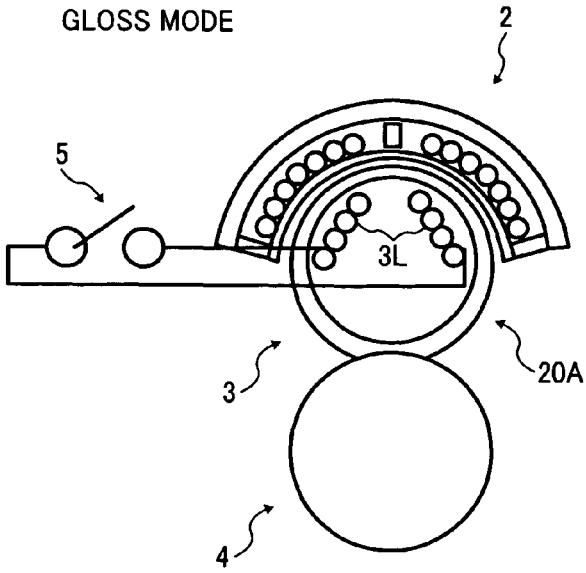
FIG. 13B is a sectional view (according to an example embodiment) of the fixing device shown in FIG. 11B in the gloss mode.

FIG. 13A illustrates the fixing device 20A in the normal mode in which the switch element 5 is turned on to activate the degaussing function as illustrated in FIG. 11A. FIG. 13B illustrates the fixing device 20A in the gloss mode in which the switch element 5 is turned off to deactivate the degaussing function as illustrated in FIG. 11B.

Figure 14:
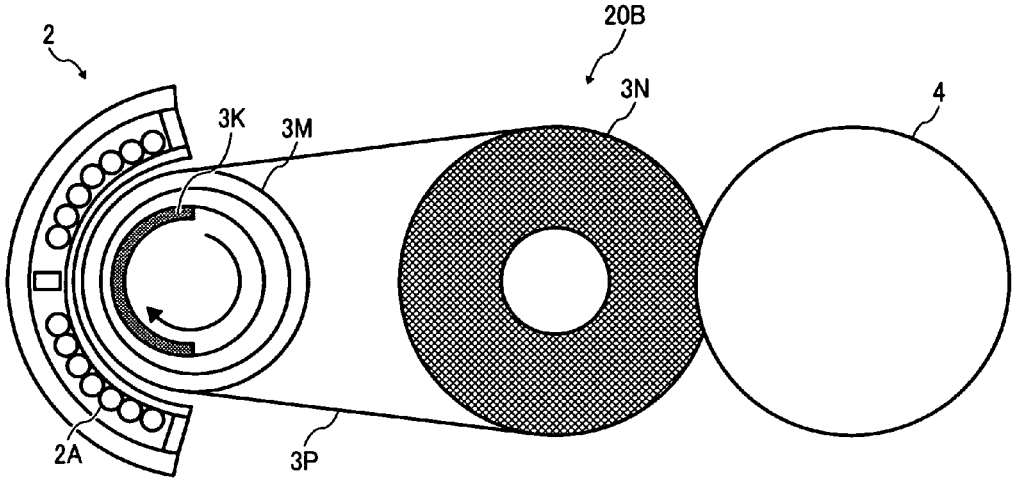
FIG. 14 is a sectional view of a fixing device according to yet another example embodiment.

FIG. 14 illustrates a fixing device 20B according to yet another example embodiment. The fixing device 20B includes a heating roller 3M, a rotating fixing member 3N, and/or a fixing belt 3P. The other elements of the fixing device 20B are common to the fixing device 20 depicted in FIGS. 10A and 10B.

The heating roller 3M, serving as a rotating heat generation member, replaces the fixing roller 3 depicted in FIGS. 6A and 6B and includes a magnetic body. The rotating fixing member 3N has elasticity and release property. The fixing belt 3P is looped over the heating roller 3M and the rotating fixing member 3N.

The degaussing member 3K is provided inside the heating roller 3M. The fixing device 20B has a basic structure similar to the structure of the fixing device 20 depicted in FIGS. 6A and 6B and may provide the degaussing function provided by the fixing device 20.

In the fixing device 20B, the heating roller 3M generates heat using a magnetic flux generated by the magnetic flux generator 2. Heat is transmitted from the heating roller 3M to the fixing belt 3P. The pressing roller 4 presses the rotating fixing member 3N via the fixing belt 3P to form a nip between the pressing roller 4 and the fixing belt 3P. At the nip, the fixing belt 3P and the pressing roller 4 apply heat and pressure to a recording sheet passing through the nip to fix a toner image on the recording sheet.

Figure 15:
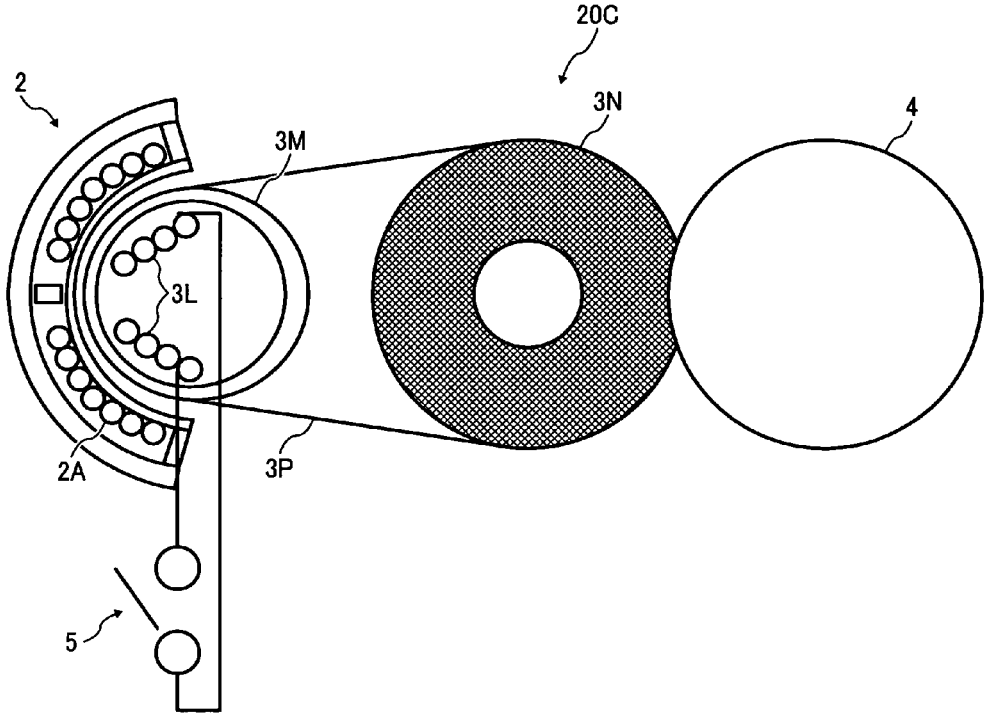
FIG. 15 is a sectional view of a fixing device according to yet another example embodiment.
Figure 16A:
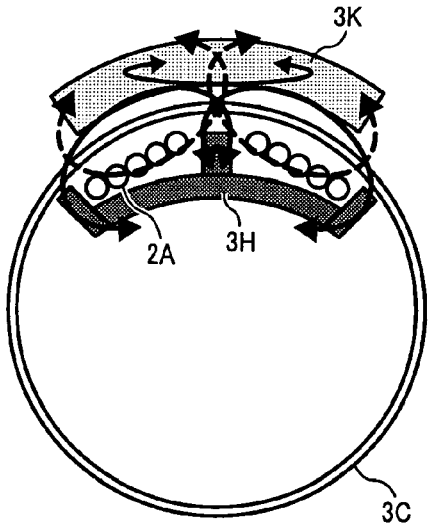
FIG. 16A is a sectional view (according to an example embodiment) of an excitation coil provided inside the fixing roller and the degaussing member provided outside the fixing roller when a degaussing function is activated.
Figure 16B:
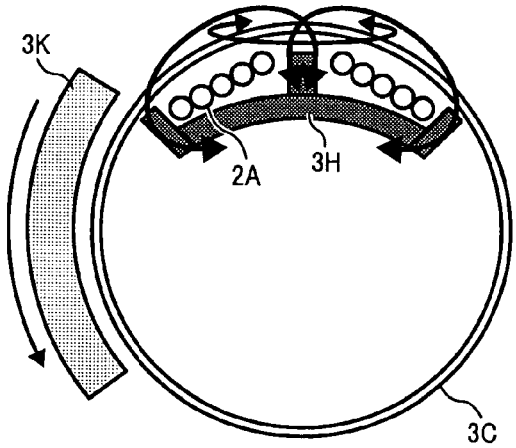
FIG. 16B is a sectional view (according to an example embodiment) of the excitation coil provided inside the fixing roller and the degaussing member provided outside the fixing roller when a degaussing function is not activated.
Figure 17A:
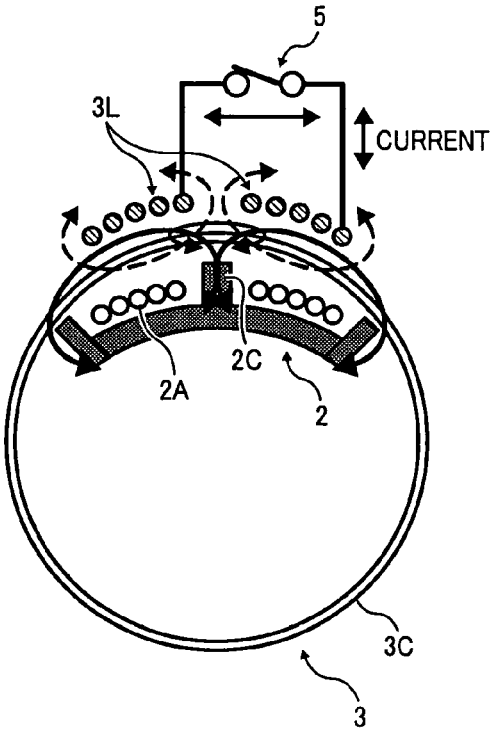
FIG. 17A is a sectional view of a fixing device according to another example embodiment when a degaussing function is activated.
Figure 17B:
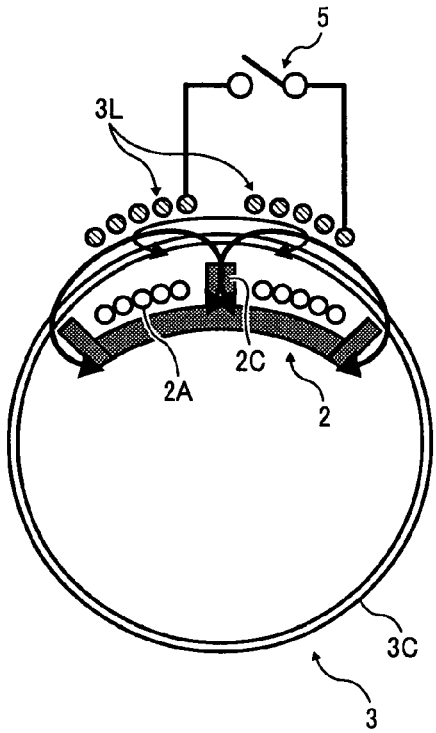
FIG. 17B is a sectional view of a fixing device according to another example embodiment when the degaussing function is not activated.
Figure 18:
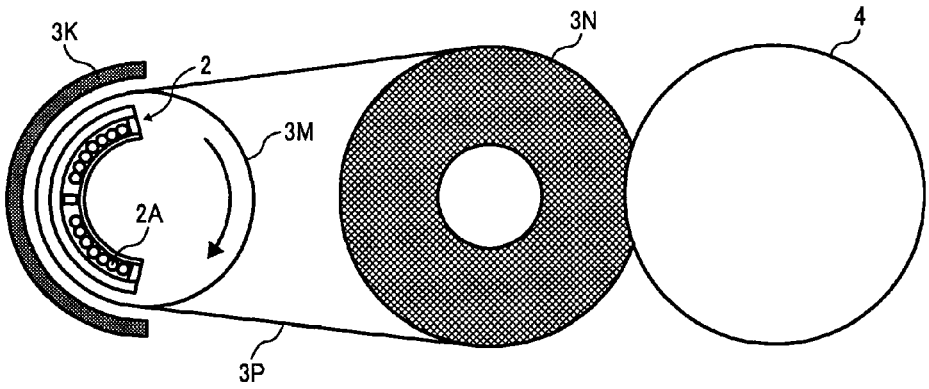
FIG. 18 is a sectional view of a fixing device according to yet another example embodiment.
Figure 19:
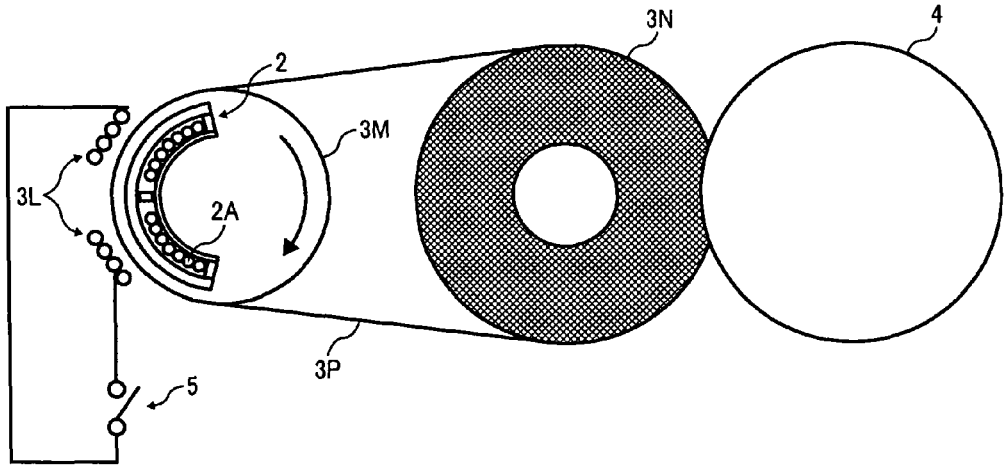
FIG. 19 is a sectional view of a fixing device according to yet another example embodiment.

FIG. 15 illustrates a fixing device 20C according to yet another example embodiment. The fixing device 20C includes the heating roller 3M, the rotating fixing member 3N, and/or the fixing belt 3P (depicted in FIG. 14). The other elements of the fixing device 20C are common to the fixing device 20A depicted in FIGS. 13A and 13B. The pair of degaussing coils 3L is provided inside the heating roller 3M. The switch element 5 is connected to the pair of degaussing coils 3L. The fixing device 20C has a basic structure similar to the structure of the fixing device 20A depicted in FIGS. 11A and 11B and may provide the degaussing function provided by the fixing device 20A.

According to the above-described example embodiments, the degaussing function may be selectively used. Therefore, a fixing device (e.g., the fixing device 20, 20A, 20B, or 20C) may selectively perform its self-temperature-control function. Accordingly, even when the fixing device includes a magnetic shunt alloy, the fixing device may be heated up to a desired temperature.

According to the above-described example embodiments, an excitation coil (e.g., the coil 2A depicted in FIGS. 6A, 11A, 14, and 15) is provided outside a rotating magnetic shunt layer (e.g., the magnetic shunt layer 3C depicted in FIGS. 6A and 11A), and a degaussing member (e.g., the degaussing member 3K depicted in FIGS. 6A and 14) or a supplemental coil (e.g., the pair of degaussing coils 3L depicted in FIGS. 11A and 15) is provided inside the rotating magnetic shunt layer 3C. However, the excitation coil may be provided inside the rotating magnetic shunt layer, and the degaussing member or the supplemental coil may be provided outside the rotating magnetic shunt layer, as illustrated in FIGS. 16A, 16B, 17A, 17B, 18, and 19.

According to the above-described example embodiments, an excitation coil (e.g., the coil 2A depicted in FIGS. 6A, 11A, 14, and 15) is provided outside a rotating magnetic shunt layer (e.g., the magnetic shunt layer 3C depicted in FIGS. 6A and 11A), and a degaussing member (e.g., the degaussing member 3K depicted in FIGS. 6A and 14) or a supplemental coil (e.g., the pair of degaussing coils 3L depicted in FIGS. 11A and 15) is provided inside the rotating magnetic shunt layer 3C. However, the excitation coil may be provided inside the rotating magnetic shunt layer, and the degaussing member or the supplemental coil may be provided outside the rotating magnetic shunt layer.

The present invention has been described above with reference to specific example embodiments. Nonetheless, the present invention is not limited to the details of example embodiments described above, but various modifications and improvements are possible without departing from the spirit and scope of the present invention. It is therefore to be understood that within the scope of the associated claims, the present invention may be practiced otherwise than as specifically described herein. For example, elements and/or features of different illustrative example embodiments may be combined with each other and/or substituted for each other within the scope of the present invention.

What is claimed is:

1. A fixing device, comprising:

an excitation coil to generate a magnetic flux;

a heat-generating layer to generate heat using the magnetic flux generated by the excitation coil;

a magnetic shunt layer to transmit heat generated by the heat-generating layer; and a degaussing member to sandwich the magnetic shunt layer together with the excitation coil, the degaussing member configured to operate selectively to degauss by generating a repelling magnetic flux for canceling the magnetic flux generated by the excitation coil to activate a self-temperature-control function and to refrain from degaussing to deactivate the self-temperature-control function, wherein the degaussing member includes a switch element to open and close an electrical circuit including a supplemental coil and selectively supply power to the electrical circuit.

2. The fixing device according to claim 1, wherein the magnetic shunt layer is rotatable, the excitation coil is provided outside the rotating magnetic shunt layer, and the degaussing member is provided inside the rotating magnetic shunt layer.

3. The fixing device according to claim 2, further comprising:

a rotating heat generation member including the heat-generating layer and having one of sleeve, roller, and belt shapes; and a rotating pressing member to pressingly contact the rotating heat generation member to form a nip between the rotating pressing member and the rotating heat generation member, the nip at which the rotating heat generation member and the rotating pressing member apply heat and pressure to a recording medium bearing a toner image to fix the toner image on the recording medium when the recording medium passes through the nip.

4. The fixing device according to claim 3, further comprising:

a rotating fixing member to oppose the rotating pressing member, wherein the rotating heat generation member includes a heating roller and a fixing belt looped over the heating roller and the rotating fixing member.

5. The fixing device according to claim 1, wherein the magnetic shunt layer is rotatable, the excitation coil is provided inside the rotating magnetic shunt layer, and the degaussing member is provided outside the rotating magnetic shunt layer.

6. The fixing device according to claim 5, further comprising:

a rotating heat generation member including the heat-generating layer and having one of sleeve, roller, and belt shapes; and a rotating pressing member to pressingly contact the rotating heat generation member to form a nip between the rotating pressing member and the rotating heat generation member, the nip at which the rotating heat generation member and the rotating pressing member apply heat and pressure to a recording medium bearing a toner image to fix the toner image on the recording medium as the recording medium passes through the nip.

7. The fixing device according to claim 6, further comprising:

a rotating fixing member to oppose the rotating pressing member, wherein the rotating heat generation member includes a heating roller and a fixing belt looped over the heating roller and the rotating fixing member.

8. The fixing device according to claim 1, wherein the degaussing member further comprises a power source to drive the supplemental coil by applying a high-frequency current having a phase different from a phase applied to the excitation coil to cause the supplemental coil to generate a magnetic flux canceling the magnetic flux generated by the excitation coil.

9. The fixing device according to claim 1, wherein the degaussing member has a plate shape and includes a material having a volume resistivity lower than a volume resistivity of a magnetic shunt alloy included in the magnetic shunt layer, and wherein the degaussing member is configured to oppose the excitation coil to activate the self-temperature-control function and to not oppose the excitation coil to deactivate the self-temperature-control function.

10. The fixing device according to claim 9, wherein the degaussing member rotates to a position not opposing the excitation coil to deactivate the self-temperature-control function.

11. The fixing device according to claim 10, further comprising:

a magnetic core to rotate with the degaussing member, the magnetic core including a semicircular portion including a high-resistance magnetic body, the semicircular portion provided opposite the degaussing member in a direction of rotation of the degaussing member.

12. An image forming apparatus, comprising:

a fixing device to apply heat to a recording medium bearing a toner image to fix the toner image on the recording medium, the fixing device comprising:

an excitation coil to generate a magnetic flux;

a heat-generating layer to generate heat using the magnetic flux generated by the excitation coil;

a magnetic shunt layer to transmit heat generated by the heat-generating layer; and a degaussing member to sandwich the magnetic shunt layer together with the excitation coil, wherein the degaussing member is configured to operate selectively to degauss by generating a repelling magnetic flux for canceling the magnetic flux generated by the excitation coil to activate a self-temperature-control function and to refrain from degaussing to deactivate the self-temperature-control function, and wherein the degaussing member includes a switch element to open and close an electrical circuit including a supplemental coil and selectively supply power to the electrical circuit.

13. An image forming apparatus, comprising:

a fixing device to apply heat to a recording medium bearing a toner image to fix the toner image on the recording medium, the fixing device including:

an excitation coil to generate a magnetic flux;

a heat-generating member to generate heat using the magnetic flux generated by the excitation coil;

a magnetic shunt member opposing the excitation coil via the heat-generating member and having a Curie temperature; and a degaussing member to sandwich the magnetic shunt member together with the excitation coil;

wherein the degaussing member is movable between a first position at which the degaussing member degausses the magnetic flux generated by the excitation coil and permeating the magnetic shunt member and a second position at which the degaussing member degausses the magnetic flux generated by the excitation coil and permeating the magnetic shunt member less than the first position; and wherein the fixing device provides a first print mode to apply a first temperature to the recording medium and a second print mode to apply a second temperature higher than the first temperature to the recording medium, and the degaussing member moves to the second position in the second print mode.

14. The image forming apparatus according to claim 13, wherein the degaussing member opposes the excitation coil at the first position and the degaussing member does not oppose the excitation coil at the second position.

15. The image forming apparatus according to claim 14, wherein the degaussing member rotates to move between the first position and the second position.

16. The image forming apparatus according to claim 15, wherein the fixing device further comprises a magnetic core to rotate with the degaussing member, and wherein the magnetic core is at the first position when the degaussing member is at the second position.

17. The image forming apparatus according to claim 13, wherein the fixing device further comprises a fixing sleeve or a fixing heat-generating belt which includes the heat-generating member and the magnetic shunt member.

* * * * *